US005597361A

United States Patent [19]

Hope

[11] Patent Number: 5,597,361

[45] Date of Patent: Jan. 28, 1997

[54] GOLF CLUB STRIKE INDICATOR

[76] Inventor: Norman B. Hope, P.O. Box 1629, Princeton, British Columbia, Canada, V0X 1N0

[21] Appl. No.: 564,098

[22] PCT Filed: Jun. 10, 1994

[86] PCT No.: PCT/CA94/00315

§ 371 Date: Dec. 11, 1995

§ 102(e) Date: Dec. 11, 1995

[87] PCT Pub. No.: WO94/28982

PCT Pub. Date: Dec. 22, 1994

[30] Foreign Application Priority Data

Jun. 11, 1993 [CA] Canada ..... 2093933

[51] Int. Cl.[6] ..... A63B 69/36

[52] U.S. Cl. ..... 473/237

[58] Field of Search ..... 473/237

[56] References Cited

U.S. PATENT DOCUMENTS

| | | | |
|---|---|---|---|
| 3,071,379 | 1/1963 | Ramsey | 473/237 |
| 5,033,746 | 7/1991 | Jones | 473/237 |
| 5,142,309 | 8/1992 | Lee | 473/237 |

*Primary Examiner*—George J. Marlo
*Attorney, Agent, or Firm*—Dominik & Stein

[57] ABSTRACT

A self-adhesive indicator which adheres to a golf club face to provide an indication of the point of impact of the golf ball on the club face is provided. It consists of a sandwich of various layers—a layer of pressure-sensitive adhesive on the bottom, followed by a layer of energy-absorbing elastomeric material on which is provided a film of a thermochromic material such as a temperature sensitive liquid crystal, followed by a top layer of clear high impact plastic.

15 Claims, 3 Drawing Sheets

GOLF CLUB STRIKE INDICATOR

TECHNICAL FIELD

The invention relates to golfing aids, and more particularly to devices for identifying and indicating the location on the club face which is struck by the golf ball.

BACKGROUND ART

Numerous aids are available to assist the golfer in improving his or her golf stroke. For example, it is useful to the golfer to be able to identify the location on the club face struck by the ball so that the golfer can modify his or her stance, grip or swing to improve the impact location to result in greater distance or avoid hooking or slicing shots. As with tennis racquets, golf club heads have a "sweet spot" which is the optimum location for striking the ball to provide maximum distance and accuracy.

One golfing aid which assists in determining the location of impact of the golf ball on the club head in a golfer's stroke is disclosed in U.S. Pat. No. 4,826,173 Brown. It provides a hook and loop fastener, one component of which covers the club face and the other component of which is made into a ring to form the "ball". When the club strikes the "ball" the "ball" sticks to the club face to indicate the impact location. This apparatus however does not reproduce the striking of an actual golf ball to allow the mimicking of an actual golf shot.

Another prior art device is disclosed in U.S. Pat. No. 4,898,389 Plutt. This device uses an array of electronic transducers attached to the club face to sense the impact of the ball and communicate electric signals to a processor which displays the point of impact electronically. Such a device is sufficiently expensive to produce and difficult to use to discourage widespread acceptance. A simpler device is disclosed in U.S. Pat. No. 5,033,746 Jones. this patent discloses a device for marking the point of impact of a golf ball on the face of a golf club. It comprises an outer translucent sheet of one colour which is connected to an underlying sheet of a contrasting colour. There is a layer of pressure sensitive adhesive between the two sheets such that the impact of a golf ball causes the two sheets to adhere and the colour of the underlying sheet to show through the translucent sheet in the area of impact. This device has been found to deteriorate after the impact and leave an imprecise impression of the impact location. Another similar device is disclosed in International Application no. PCT/GB89/01036, published 22 Mar. 1990 under WO 90/02586. In this device, two sheets form a pocket containing a high viscosity coloured liquid. The pocket is mounted on a club face by adhesive. The thickness of the viscous liquid and shape of the impact area indicates the point of impact of the ball on the club face and the impact angle.

Consequently there is a need for a golf club strike indicator which is inexpensive to produce, easy to apply and remove, can be re-used numerous times and provides an accurate impression of the impact location of the golf ball on the club face.

DISCLOSURE OF INVENTION

The invention provides a self-adhesive sticker or decal which adheres to the club face. It consists of a sandwich of four layers—a layer of pressure-sensitive adhesive on the bottom, followed by a layer of high-hysteresis (energy-absorbing) elastomeric material on which is provided a film of a thermochromic material, such as a temperature sensitive liquid crystal, followed by a top layer of a clear high impact plastic.

BRIEF DESCRIPTION OF DRAWINGS

In drawings which illustrate an embodiment of the invention.

BEST MODE(S) FOR CARRYING OUT THE INVENTION

Figure 1:
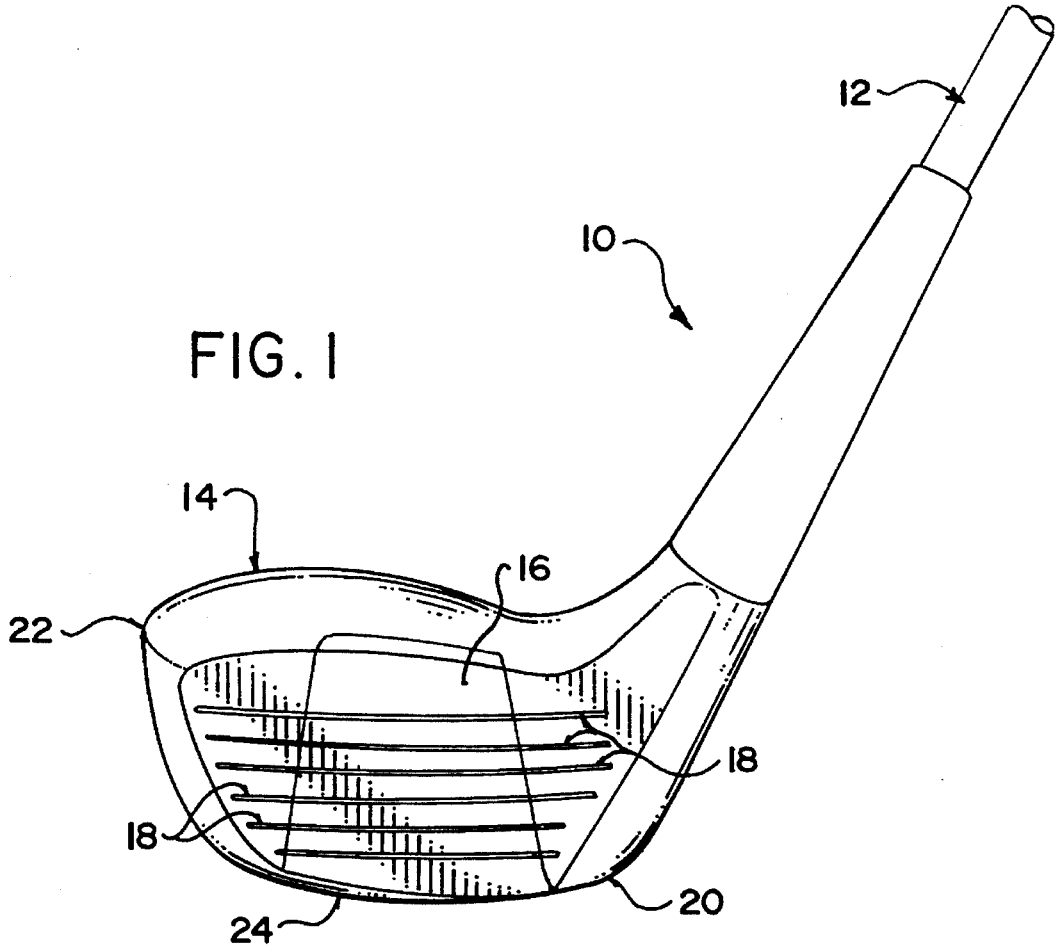
FIG. 1 is a perspective view of a golf club head.

A golf club shown in FIG. 1, in particular a driver 10, has a shaft 12 to which is attached a club head 14 of wood, metal or composite material. Club head 14 has a face 16 on which are cut slots or grooves 18 to impart spin to the ball. Club head 14 also has a heel 20, toe 22 and sole 24.

Figure 4:
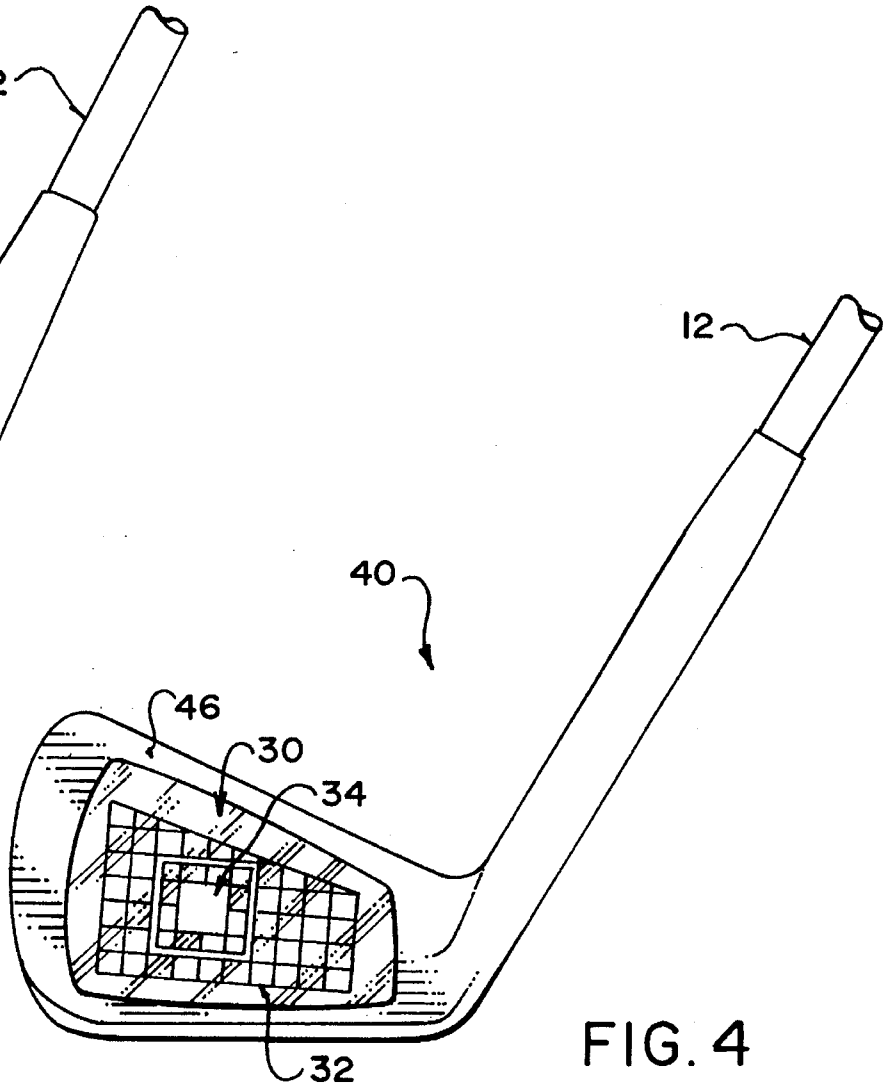
FIG. 4 is a perspective view of the invention applied to an iron head.
Figure 3:
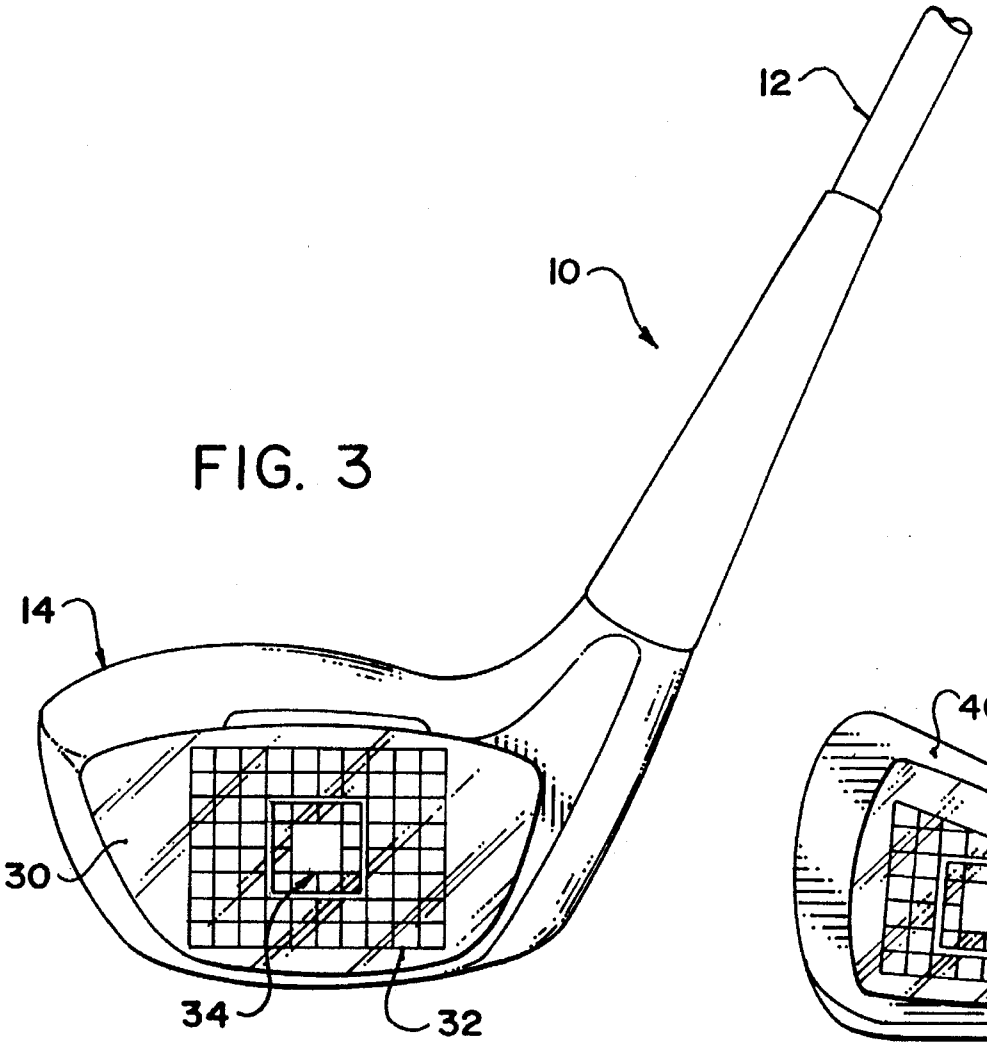
FIG. 3 is a perspective view of the invention applied to a driver head.
Figure 5:
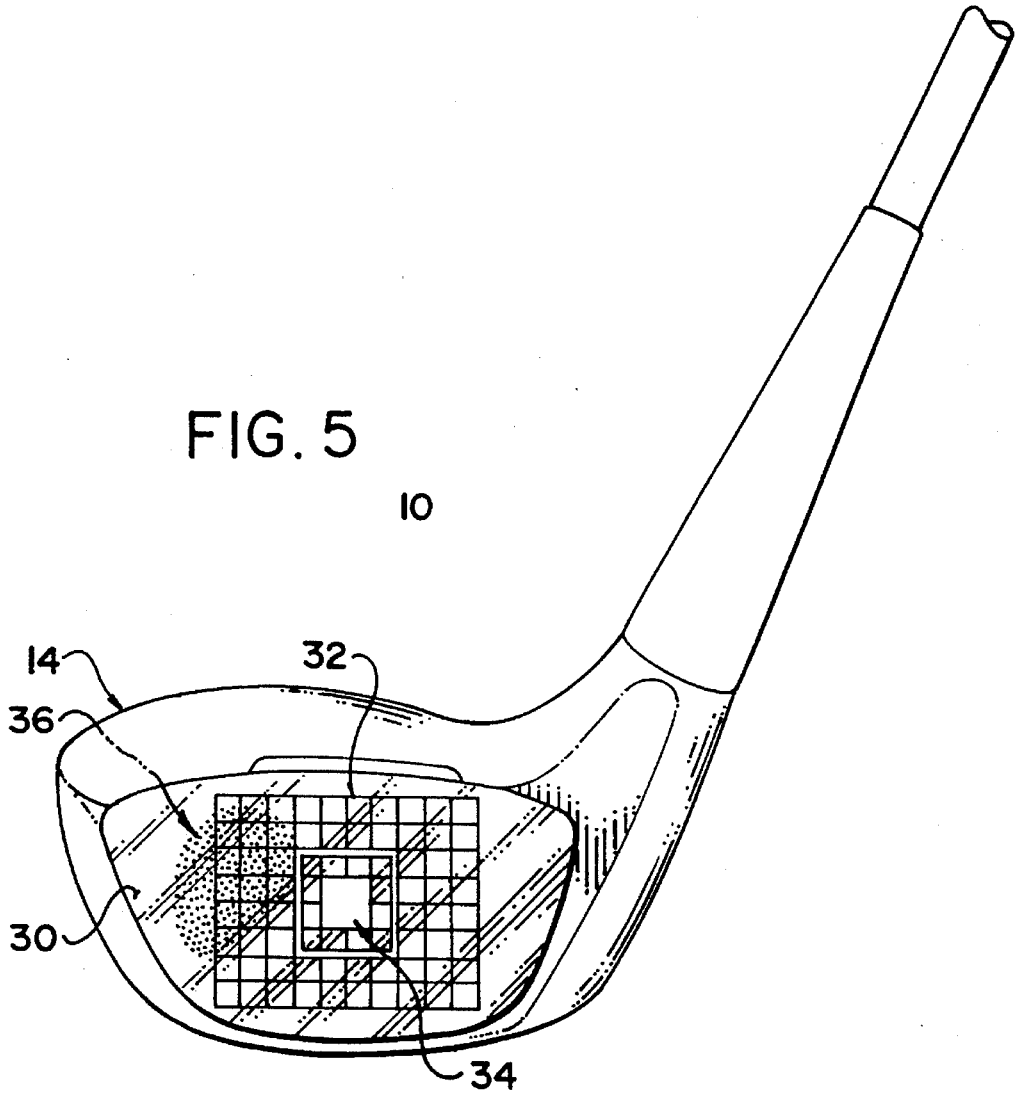
FIG. 5 is a perspective view of the invention applied to a driver head, after impact with a golf ball.

The invention 30 is shown applied to the face 16 of the driver 10 in FIG. 3 and the face 46 of an iron 40 in FIG. 4. It may have printed on its surface a grid such as that shown as 32 to guide the golfer to the preferred location 34, or sweet spot, for a particular club head. FIG. 5 illustrates the appearance of the invention on the club face after striking a ball, with a darkened area 36 indicating the area of impact of the golf ball on the club face. The golfer will then refer to written material or an instructor to determine the necessary changes in stance, grip, etc. to improve the impact location.

Figure 2:
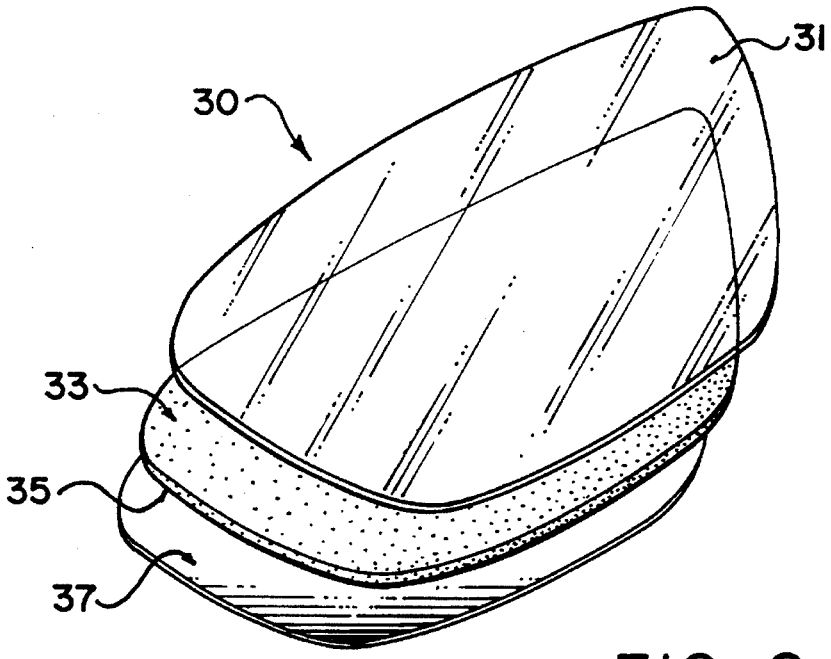
FIG. 2 is a perspective view of the invention, partially exploded.

The structure of the invention is illustrated in FIG. 2. The top layer 31 consists of a clear plastic, such as a high impact polystyrene, polyvinyl chloride (PVC) or polycarbonate such as LEXAN™, of a thickness on the order of approximately 100 to 250 microns. It may have a grid 32 printed or etched onto its outer surface. Alternatively grid 32 could be printed or etched on the lower surface of layer 31, or the upper surface of layer 33. Top layer 31 should be a high impact plastic so it is sufficiently durable to withstand the mechanical abuse of repeated striking by a golf ball. It may be textured in order to provide sufficient friction to impart spin to the golf ball.

Applied to the lower or rear surface of layer 31 is a film of a temperature sensitive liquid crystal, such as that manufactured and sold under the trademark THERMAX by Thermographic Measurements Ltd. of South Wirral, United Kingdom. Other suitable temperature sensitive liquid crystal films are manufactured by Davis Liquid Crystals, Inc. of San Leandro, Calif. and Hallcrest Products, Inc. of Glenview, Ill. The film should be a temperature sensitive liquid crystal film having a temperature response in the range 5 degrees C. to 50 degrees C. with the preferred range covering 5 degrees C. to 40 degrees C. Such temperature sensitive liquid crystal films change through a range of colours as a function of temperature change. A micro-encapsulated liquid crystal film is preferred, but non-encapsulated temperature sensitive liquid crystal films could also be used. While temperature sensitive liquid crystal is the preferred material for the invention, other thermochromic materials, such as leuko dyes or other thermochromic chemical films would also be useful in the invention.

The liquid crystal film is bound to layer 31 by an adhesive binder, such as an acrylic binder. Applied over the liquid crystal layer is a backing layer of black paint of 1–2 mils (0.025 mm to 0.05 mm) in thickness. The layer of black paint may be applied for example by screen printing. Layer 31 and adhered layers of liquid crystal and paint are adhered to underlying layer 33 by a suitable adhesive layer, such as a pressure sensitive adhesive, applied to the back of the paint layer. Layer 33 is a layer of high-hysteresis (energy-absorbing) elastomeric foam, such as that sold under the trademark ENSOLITE, of a thickness 1/32 in.–1/8 in. (0.8 mm to 3.2 mm) and preferably 1/16 inch (1.6 mm) depending on the club for which the indicator is designed. No foam layer 33 is required for the invention for use on putters. A layer of pressure sensitive adhesive, having a relatively low level of adherence, is applied to the lower surface 35 of layer 33. A peel-off coated paper layer 37 is provided over the pressure sensitive adhesive to cover the adhesive until the device is attached to the club head.

To use the device, the paper layer 37 is peeled off and the device 30 is stuck to face 16 of club 10, as shown in FIG. 3, by applying the pressure sensitive adhesive surface of the device to the club face. The golfer then strikes the golf ball with the desired stroke. A portion of the energy of the impact of the golf ball on the club face will be converted to thermal energy by the energy-absorbing elastomer layer 33 and is conducted to the liquid crystal film. The resulting temperature rise in the temperature sensitive liquid crystal film is temporarily displayed as a localized colour display, shown as 36 in FIG. 5. The display will disappear in 5 to 10 seconds as the temperature differential disappears.

Figure 6:
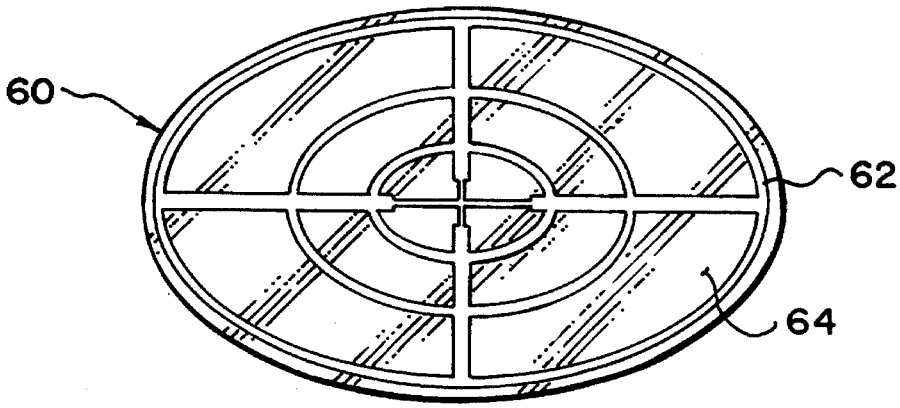
FIG. 6 is a plan view of a further embodiment of the invention.

FIG. 6 illustrates an indicator 60 according to the invention in a preferred shape, with a target pattern 62 printed on the clear plastic layer 64.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A device (30) for providing a temporary indication (34) of the area of impact of a ball, such as a golf ball, on a ball-striking face, such as a golf club face, said device having an inner surface for adherence to said ball-striking face and an outer impact surface, said inner surface of said device comprising means for removably securing said device to said ball striking face, characterized in that said device further comprises:

a) a sheet (31) of light transmitting, hard, durable material sized to fit on said ball-striking face, having first and second surfaces, said first surface forming said outer impact surface of said device; and b) a layer of thermochromic material provided on said second surface of said sheet (31) of light transmitting, hard durable material.

2. A device (30) for providing a temporary indication of the area of impact of a ball, such as a golf ball, on a ball-striking face, such as a golf club face, said device having an inner surface for adherence to said ball-striking face and an outer impact surface, said inner surface of said device comprising means for removably securing said device to said ball striking face, characterized in that said device further comprises:

a) a sheet (31) of light transmitting, hard durable material sized to fit on said ball-striking face, having first and second surfaces, said first surface forming said outer impact surface of said device;

b) a sheet (35) of energy-absorbing elastomeric material having an outer and an inner surface and sized to fit on said golf club face; and c) a layer of thermochromic material sandwiched between said second surface of said sheet (31) of light transmitting, hard durable material and said outer surface of said sheet (35) of energy-absorbing elastomeric material.

3. The device of claims 1 or 2 wherein said layer of thermochromic material is a layer of temperature sensitive liquid crystal.

4. The device of claim 3 wherein said temperature sensitive liquid crystal has a temperature response in the range 5 degrees C. to 40 degrees C.

5. The device of claims 1 or 2 wherein said sheet (31) of light transmitting, hard durable material is a high impact plastic.

6. The device of claims 1 or 2 wherein said means for removably securing said device to said ball striking face comprises a layer of pressure sensitive adhesive.

7. The device of claim 6 further comprising a removable flexible protective sheet (37) adhered to and covering said layer of pressure sensitive adhesive.

8. The device of claims 1 or 2 further comprising a light absorbing layer between said layer of thermochromic material and said means for removably securing said device to said ball striking face.

9. The device of claim 8 wherein said light absorbing layer is black.

10. The device of claim 8 wherein said light absorbing layer is a dark paint.

11. The device of claim 2 further comprising a light absorbing layer between said layer of thermochromic material and said means for removably securing said device to said ball striking face wherein said light absorbing layer is adhered to said outer surface of said sheet (35) of energy-absorbing elastomeric material.

12. The device of claim 2 wherein said means for removably securing said device to said ball striking face comprises a layer of pressure sensitive adhesive provided on said inner surface of said sheet (35) of energy-absorbing elastomeric material.

13. The device of claim 2 wherein said sheet (35) of energy-absorbing elastomeric material is a high hysteresis elastomeric foam having a thickness in the range 0.8 mm to 3.2 mm.

14. The device of claims 1 or 2 wherein said sheet (31) of light transmitting, hard durable material is provided with markings to locate a preferred area of impact for a predetermined ball-striking face.

15. The device of claims 1 or 2 wherein said sheet (31) of light transmitting, hard durable material is textured.

* * * * *